US006564901B2

(12) United States Patent
Woods

(10) Patent No.: US 6,564,901 B2
(45) Date of Patent: May 20, 2003

(54) MUFFLER FOR MARINE ENGINE

(76) Inventor: Woodrow E. Woods, 3640 Fiscal Ct., Riviera Beach, FL (US) 33404

( * ) Notice: Subject to any disclaimer, the term of this patent is extended or adjusted under 35 U.S.C. 154(b) by 85 days.

(21) Appl. No.: 09/803,186

(22) Filed: Mar. 9, 2001

(65) Prior Publication Data

US 2001/0025739 A1 Oct. 4, 2001

Related U.S. Application Data

(60) Provisional application No. 60/187,980, filed on Mar. 9, 2000.

(51) Int. Cl.[7] ..... F01N 7/12; F01N 1/14; F01N 3/00; B63H 21/38

(52) U.S. Cl. ..... 181/235; 181/260; 181/221; 440/89

(58) Field of Search ..... 181/212, 214, 181/220, 221, 227, 228, 233, 235, 259, 264, 268, 270, 260, 262; 440/89

(56) References Cited

U.S. PATENT DOCUMENTS

| | | | | |
|---|---|---|---|---|
| 1,821,688 A | | 9/1931 | Bourne | |
| 1,922,848 A | | 8/1933 | Harley | |
| 2,306,636 A | * | 12/1942 | Maxim | 181/212 |
| 2,396,952 A | | 3/1946 | Huber | |
| 2,933,148 A | | 4/1960 | Hendry | |
| 3,077,240 A | | 2/1963 | Betts | |
| 3,191,714 A | | 6/1965 | Phillips | |
| 3,613,830 A | * | 10/1971 | Hubbell, III | 181/260 |
| 4,825,652 A | | 5/1989 | Curran | |
| 5,123,501 A | | 6/1992 | Rothman | |
| 5,413,189 A | * | 5/1995 | Browning et al. | 181/265 |
| 5,661,272 A | | 8/1997 | Iannetti | |
| 5,824,970 A | | 10/1998 | Gracia | |
| 5,934,959 A | * | 8/1999 | Inman et al. | 181/256 |
| 6,024,617 A | * | 2/2000 | Smullin et al. | 181/260 |

FOREIGN PATENT DOCUMENTS

| | | | | |
|---|---|---|---|---|
| FR | 646808 | | 11/1928 | |
| GB | 411250 | | 7/1934 | |
| GB | 632120 | | 11/1949 | |
| GB | 2158878 A | * | 11/1985 | F01N/1/08 |

* cited by examiner

*Primary Examiner*—Robert E. Nappi
*Assistant Examiner*—Patrick Miller
(74) *Attorney, Agent, or Firm*—Mark D. Bowen, Esq.; Stearns Weaver Miller Weissler Alhadeff & Sitterson, P.A.

(57) ABSTRACT

A marine engine muffler is provided having a silencing element with an inclined surface defining an array of elongate slotted apertures generally disposed in circumferential alignment. The slotted apertures are preferably defined by angled sidewalls such that exhaust gas flowing therethrough is forced to travel in a path that forms a reverse angle relative to the overall exhaust flow path thus conducting exhaust gases and entrained water to reverse direction while flowing through the silencing element. The conical silencing element is specifically sized to avoid resonant vibration within the operational RPM range of the engine and is further sized relative to the combined displacement of the engine and/or cylinder bank in fluid communication therewith to avoid resonant vibrations caused by reflected exhaust gas pressure waves generated by the internal combustion engine.

14 Claims, 3 Drawing Sheets

MUFFLER FOR MARINE ENGINE

CROSS-REFERENCE TO RELATED APPLICATIONS

This application claims the benefit of U.S. Provisional Patent Application No. 60/187,980, filed Mar. 9, 2000.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

The present invention relates generally to exhaust mufflers for internal combustion engines, and more particularly, to an in-line marine exhaust muffler having an improved conical silencing element for inserted installation into the exhaust pipe connected to an internal combustion engine on a marine vessel.

2. Description of Related Art

Marine vessels are typically configured with a propulsion system having an internal combustion engine mounted internally within the vessel hull. Exhaust generated by the engine is commonly routed through exhaust conduit to the stern or rear of the vessel via one or more exhaust ducts and is discharged through one or more exhaust ports formed in the transom. One or more silencers may be installed within the exhaust duct(s) to silence noise associated with the engine and exhaust gases.

A variety of structures are known in the background art for use in silencing marine exhaust noise. The present inventor has invented a number of novel marine exhaust components that have greatly improved the silencing and efficiency of marine exhaust systems. Among those inventions developed by the present inventor are: U.S. Pat. No. 4,918,917 for a Liquid Cooled Exhaust Flange; U.S. Pat. No. 5,196,655, for a Muffler for Marine Engines; U.S. Pat. No. 5,228,876, for a Marine Exhaust System Component comprising a heat resistant conduit; U.S. Pat. No. 5,262,600 for an In-line Insertion Muffler for Marine Engines; U.S. Pat. No. 5,444,196 for an improved In-line Insertion Muffler for Marine Engines; U.S. Pat. No. 5,504,280, for a Muffler for Marine Engines; U.S. Pat. No. 5,616,893, for a Reverse Entry Muffler With Surge Suppression Feature; U.S. Pat. No. 5,625,173, for a Single Baffle Linear Muffler for Marine Engines; U.S. Pat. No. 5,718,462 for Muffler Tube Coupling With Reinforcing Inserts; and U.S. Pat. No. 5,740,670, for a Water Jacketed Exhaust Pipe for Marine Exhaust Systems.

The background art further includes U.S. Pat. No. 5,824,970, issued to Garcia, for a conical marine engine silencer having an apertured baffle and weir plate. The Garcia device is generally depicted in FIG. 1 herein. The device includes a conical silencer element located within an exhaust duct, and a weir plate. The silencer element has apertured surfaces that are inclined to the flow of the exhaust gases in the duct. The apertured surfaces define an internal cone angle between 15° and 30°, and the apertured surfaces of the silencer element preferably form an angle with the walls of the exhaust duct of between 5° and 20°. The weir plate comprises a continuous, non-perforated plate extending generally axially to the conical silencer element body. The marine engine silencer disclosed by Garcia fails to disclose a conical silencer element that optimizes noise reduction and exhaust gas cooling. The Garcia device also fails to disclose means for optimizing noise reduction and exhaust gas cooling through use of a silencer structure configured to cause exhaust gas to experience reverse gas flow (e.g. in a partially upstream direction). Garcia also fails to disclose a silencing element having an aperture configuration optimized for silencing. Finally, Garcia fails to disclose dimensional parameters for the silencing element that are optimized relative to engine displacement to avoid resonant vibration.

Accordingly, there exists a need for an improved marine engine muffler that optimizes noise reduction by incorporating a structure that forces exhaust gas to follow a reverse flow path. In addition, there remains a need for an improved marine engine muffler having a silencing element with inclined surfaces and an aperture configuration for maximizing exhaust gas silencing. There further exists a need for an improved marine engine muffler having a conical silencer element with dimensional characteristics specifically selected to eliminate excessive vibrational responses associated with fluctuations in exhaust gas flow and resonant frequency dynamics.

BRIEF SUMMARY OF THE INVENTION

The marine engine muffler of the present invention overcomes the disadvantages of the exhaust silencing devices of the background art by providing a marine engine muffler that includes at least one silencing element having at least one surface inclined to the general direction of exhaust gas flow and having a series of elongate slotted apertures disposed circumferentially lengthwise. It has been found that the alignment of elongate slotted apertures in a direction that is perpendicular to exhaust flow (e.g. flow path shown by arrow) provides improved silencing of exhaust gas compared to the prior art muffler shown in FIG. 1 (e.g. slotted apertures disposed in an axial configuration). The conical silencing element is specifically sized and/or tuned to avoid resonant vibration within the operational RPM range of the engine. The conical silencing element is further sized relative to the combined displacement of the engine and/or cylinder bank to avoid problems associated with reflected pressure waves inherent in upstream exhaust system components. The slotted apertures are preferably bounded and defined by angled sidewalls such that exhaust gas flowing through said apertures is forced to travel in a path that is angled in a reverse direction relative to the overall exhaust flow path.

Accordingly, it is an object of the present invention to provide an improved muffler for internal combustion engines.

Another object of the present invention is to provide an improved conical silencing element for engine mufflers.

Still another object of the present invention is to provide an improved conical silencing element having slotted apertures configured so as to require exhaust gas flowing therethrough to follow in a reverse or serpentine flow path.

Yet another object of the present invention is to provide a conical silencing element for marine a muffler that is tuned to avoid resonant vibration throughout the entire RPM range of the associated marine engine.

In accordance with these and other objects that will become apparent hereinafter, the instant invention will now be described with particular reference to the accompanying drawings.

DETAILED DESCRIPTION OF THE INVENTION

Figure 1:
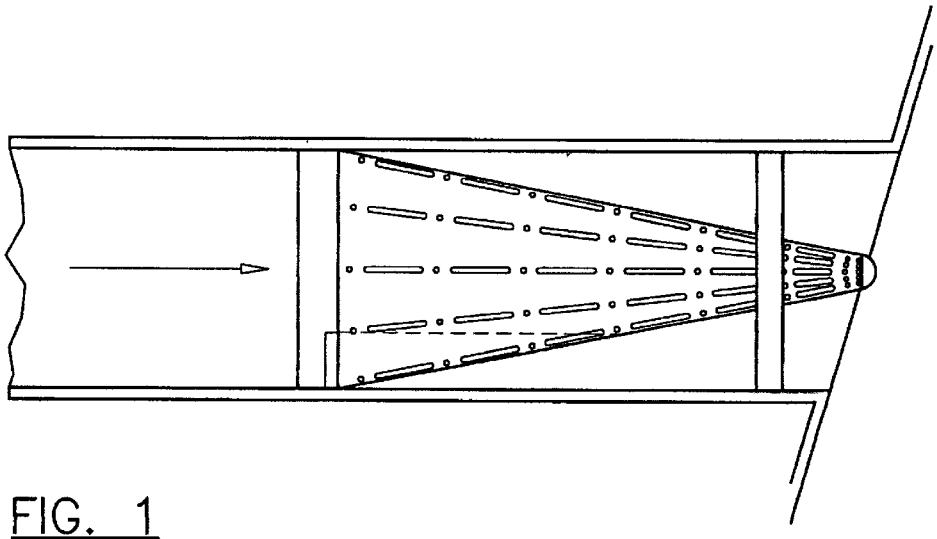
FIG. 1 PRIOR ART
FIG. 1 depicts a prior art marine engine muffler having apertured surfaces that are inclined to the flow of exhaust gases.
Figure 2:
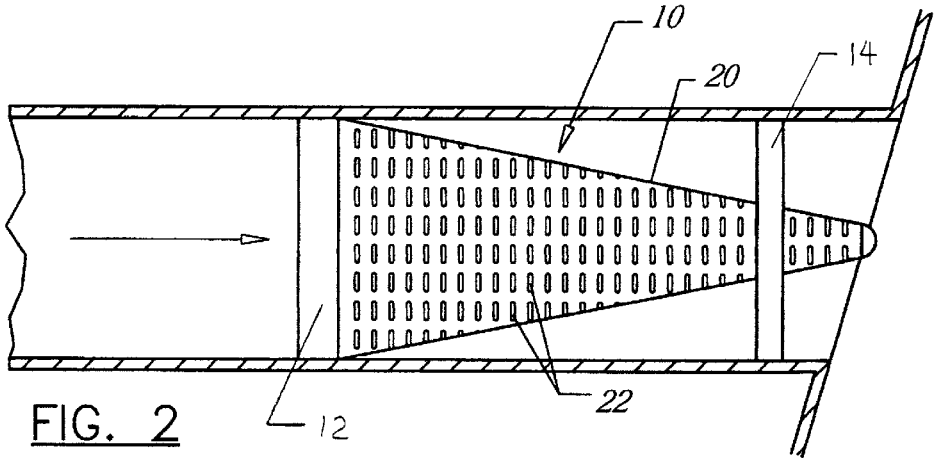
FIG. 2 depicts a side elevational view of a marine engine muffler according to the present invention.

FIG. 1 depicts a marine engine muffler according to the background art. With reference now to FIG. 2 there is disclosed an improved marine engine muffler, generally referenced as 10. Muffler 10 includes a generally cylindrical base portion 12 for attachment to the exhaust conduit, and a silencing element 20 including a baffle surface having a series of elongate slotted apertures, referenced as 22, disposed along, and aligned generally with, circumferentially intersecting planes of silencing element 20. It has been found that the use of elongated slotted apertures disposed in lengthwise circumferential alignment as shown in FIG. 2 provides improved exhaust silencing and cooling. Silencing element 20 is preferably formed of heat resistant epoxy resin material having a wall thickness preferably between ⅛" and ½". It should be noted however, that the wall thickness may be increased depending upon the volume of exhaust gas. A cross member 14 may be used to support the silencing element.

Silencing element 20 is preferably sized such that the internal volume is approximately fifteen-times (15×) the volumetric displacement of the internal combustion engine and/or of the cylinders in fluid connection therewith (e.g. 15×combined cylinder displacement). The conical silencing element is further specifically sized in length and/or tuned to avoid resonant vibration induced by pressure waves generated within the operational RPM range of the engine. In particular, the length of silencing element 20 is specifically selected to avoid resonant oscillation. The length is thus sized depending on the number of cylinders and volumetric displacement. In a preferred embodiment, conical silencing element 20 is sized relative to the combined displacement of the engine, and/or bank of cylinders served, to avoid problems associated with reflected pressure waves inherent in upstream exhaust system components. It has been found through extensive experience and trial and error experimentation that a muffler/silencing element volume of approximately fifteen-times (15×) the cylinder displacement volume provides sufficient characteristics to avoid complications associated with reflected pressure waves. Proper sizing of the muffler silencing element functions to effectively cancel and/or avoid resonance associated with pressure waves reflecting from the internal silencing element surfaces thereby maximizing the silencing effect.

Figure 3:
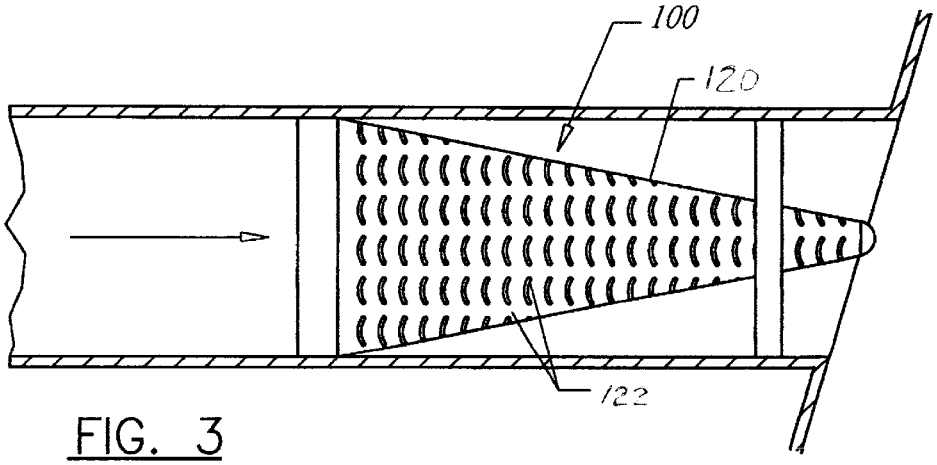
FIG. 3 depicts a side elevational view of a marine engine muffler according to the present invention having an alternate slotted aperture configuration.

In a preferred embodiment, slotted apertures 22 are bounded and defined by peripheral sidewalls that form an acute inclined surface (e.g. form an acute approach angle) relative to the exhaust flow path such that exhaust gases and entrained water flowing through said apertures are forced to travel in a path that is angled in a reverse direction relative to the overall exhaust flow path. It has been found that providing a structure that causes exhaust gas and water to flow in a reverse direction maximizes silencing and cooling of the exhaust gases. FIG. 3 shows an alternate embodiment muffler according to the present invention, generally referenced as 100. Muffler 100 includes a silencing element 120 having a configuration of arcuate slots, referenced as 122. Arcuate slotted apertures 122 may be formed by first forming the conical silencing element and then forming the slotted apertures using a saw apparatus disposed angularly. Accordingly, slotted arcuate apertures 122 are also preferably bounded and defined by a peripheral angled sidewall. Arcuate slots 122 further function to maximize dissipation of exhaust gas pressure waves.

Figure 4:
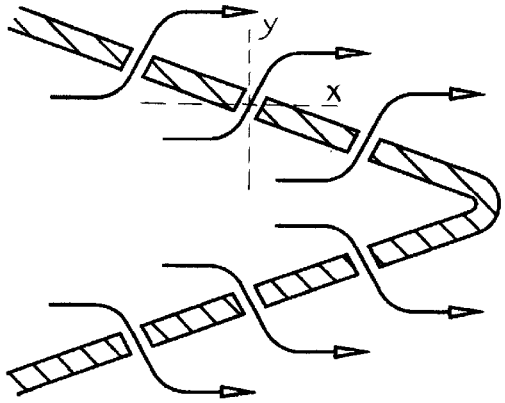
FIG. 4 PRIOR ART
FIG. 4 depicts a partial cross-sectional view of the prior art silencing element illustrating flow paths for exhaust gases.
Figure 5:
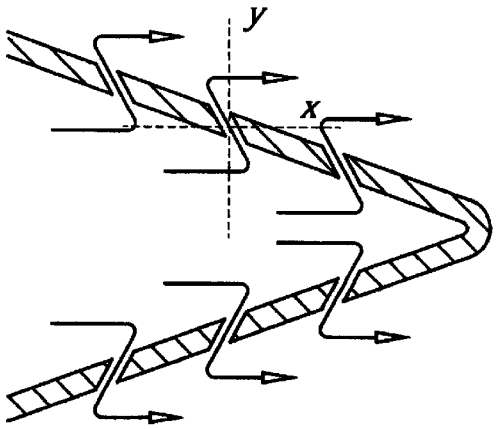
FIG. 5 depicts a partial cross-sectional view of a silencing element according to the present invention illustrating preferred flow paths for exhaust gases.

FIG. 4 depicts aperture sidewalls that are not angled so as to cause exhaust gas and entrained water to flow in a reverse direction. In contrast, FIG. 5 depicts angled aperture sidewalls according to the teaching of the present invention. As best seen in FIG. 5, the angled sidewalls force exhaust gas to flow in a reverse direction as illustrated by reference to the superimposed X-Y axis. Accordingly, exhaust gas and any entrained cooling water travel in a serpentine path, a portion of which is in a direction opposite the primary exhaust flow path. The reverse gas flow greatly enhances noise reduction and exhaust gas cooling, and provides a significant improvement over the prior art structure depicted in FIG. 4.

Figure 6:
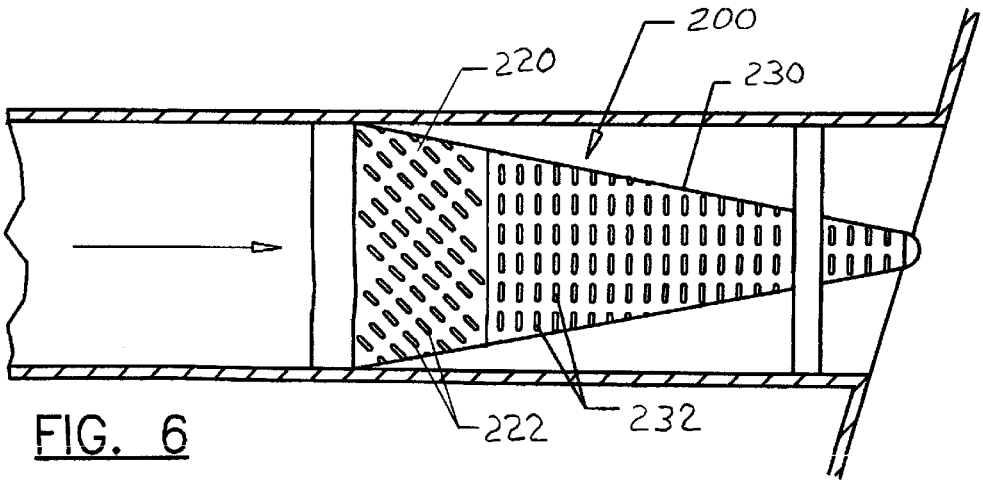
FIG. 6 is an elevational view of an alternate embodiment, multi-sectioned, silencing element configuration according to the present invention.

FIG. 6 depicts an alternate embodiment muffler, generally referenced as 200. Muffler 200 includes a multi-section silencing element, including a first section 220 and a second section 230. First silencing element section 220 defines a first array of slotted apertures 222 that are angularly disposed relative to the silencing element and/or exhaust conduit axis. Second silencing element section 230 defines a second array of slotted apertures that may be disposed in lengthwise circumferential alignment. The combination of first and second silencing element sections, and particularly first and second aperture arrays with slotted apertures disposed in dissimilar angular relation results in improved silencing. In a preferred embodiment apertures 222 are defined by angled sidewalls as described herein. The configuration of apertures 222 creates vortex of exhaust gases exiting the silencing element, which vortex further assists in silencing engine exhaust.

Figure 7:
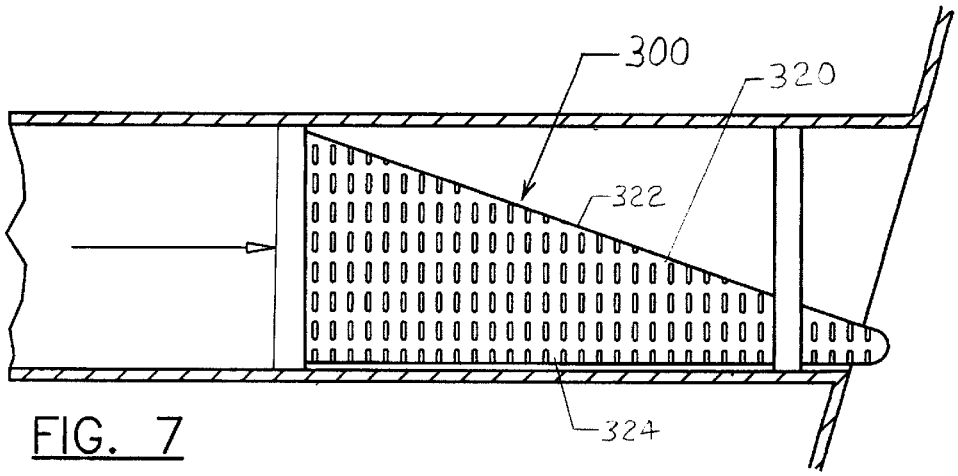
FIG. 7 is an elevational view of yet another alternate embodiment silencing element configuration according to the present invention.

FIG. 7 depicts yet another alternate embodiment muffler, generally referenced as 300. Muffler 300 includes a silencing element 320 that defines at least one surface 322 that is inclined relative to the exhaust gas flow path, and at least one other surface 324 that is aligned with the exhaust gas flow path, which flow path is indicated by the arrow. Silencing element may comprise a half cone (e.g. cone sliced axially) and/or may define a triangular cross section, or any other suitable configuration wherein at least one surface is inclined relative to exhaust gas flow and at least one other surface is parallel to exhaust gas flow.

Figure 8:
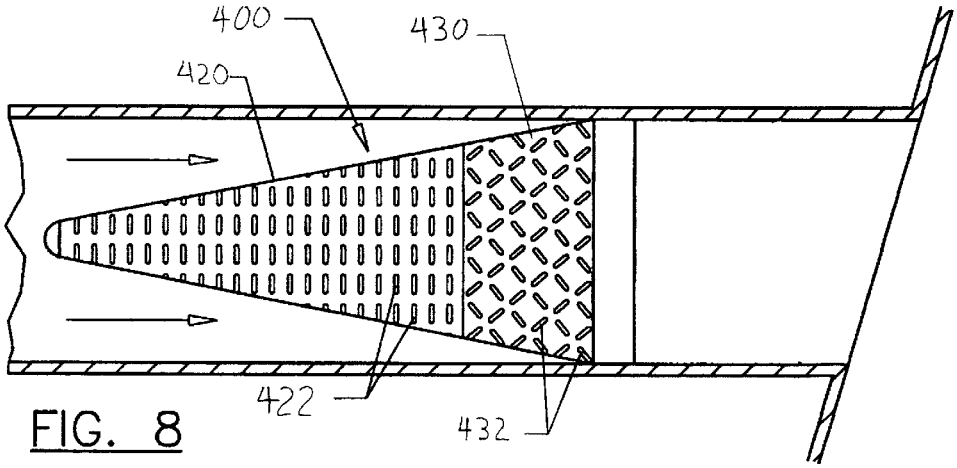
FIG. 8 is an elevational view of still another alternate embodiment, multi-sectioned, silencing element according to the present invention.

FIG. 8 depicts yet another alternate embodiment muffler, generally referenced as 400. Muffler 400 includes a multi-sectioned silencing element having first section 420 and a second section 430. First silencing element section 420 defines a plurality of slotted apertures 422 that preferably include angled sidewalls resulting in a reverse exhaust gas flow path according to the teachings disclosed herein. Second silencing element 432 may include an array of slotted apertures disposed in a crisscross pattern as depicted in FIG. 8. The crisscross pattern may be specifically adapted to simultaneously create exhaust gas vortices in both the clockwise and counterclockwise directions thereby enhancing the silencing effect and cooling through intimate mixing of exhaust gas and water.

Figure 9:
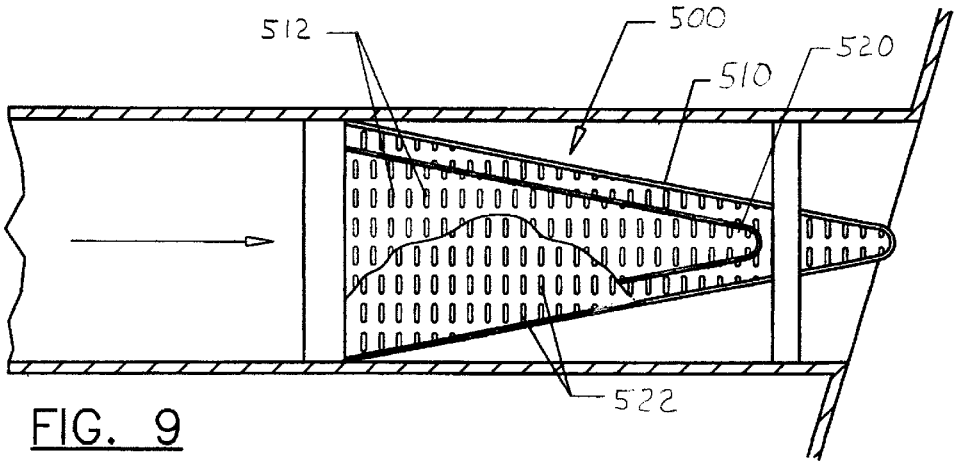
FIG. 9 is an elevational view in partial section of a muffler according to the present invention incorporating dual silencing elements.

FIG. 9 depicts yet another alternate embodiment engine muffler, generally referenced as 500. Muffler 500 includes concentrically disposed conical silencing elements, generally referenced as 510 and 520. Each silencing element defines a plurality of slotted apertures, referenced as 512 and 522 respectively. Silencing elements 510 and 520 are preferably spaced between 1" and 2" from one another. In addition, slotted apertures 512 and 522 are axially offset. Slotted apertures may be defined by angled sidewalls resulting in a reverse gas flow path according to the teachings herein.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A water-cooled exhaust gas system having an exhaust duct for conducting a flow of exhaust gases in an axial direction therethrough, said system comprising:

a silencer element located within the exhaust duct, said silencer element having at least one apertured surface inclined to the flow of exhaust gas in the duct, said apertured surface defining at least one elongate slotted aperture defined by sidewalls disposed so as to direct exhaust gases in an upstream direction relative to the axis of said duct;

wherein said silencer element is defines an internal volume of at least fifteen-times the combined volumetric displacement of the cylinders of any internal combustion engine in fluid connection therewith.

2. A water-cooled exhaust gas system according to claim 1, wherein each slotted aperture has a length axis that is substantially perpendicular to the exhaust duct axis.

3. A water-cooled exhaust gas system according to claim 1, wherein the slotted aperatures are defined by elongate arcuate sidewalls.

4. A water cooled exhaust gas system according to claim 1, further including a second silencer element disposed in overlapping spaced downstream relation with said first silencer element, said first and second silencer elements each defining apertures therein, said first silencer element apertures being axially offset from said second silencer element apertures.

5. A water cooled exhaust gas system according to claim 1, wherein said silencer element includes first and second baffle portions, said first baffle portion being inclined relative to the flow of exhaust gas, said second baffle portion being generally parallel to the flow of exhaust gas.

6. A water-cooled exhaust gas system according to claim 1, wherein said silencer element is generally conical.

7. A water-cooled exhaust gas system according to claim 1, wherein said silencer element is generally tubular.

8. A muffler for a marine engine exhaust system having an exhaust duct for conducting the flow of exhaust gases and entrained water from an engine downstream to the atmosphere, said muffler adapted for installation in the exhaust duct, said muffler comprising:

a silencing element having at least one surface thereof inclined with respect to the flow of exhaust gases through the exhaust conduit;

said silencing element defining a volume corresponding to at least fifteen-times the corresponding cylinder displacement volume of the marine engine;

said silencing element defining a plurality of apertures, said apertures having an exhaust inlet and an exhaust outlet, said exhaust outlets disposed upstream relative to said exhaust inlets.

9. A muffler for a marine engine exhaust system according to claim 8, wherein said silencing element is tubular.

10. A muffler for a marine engine exhaust system according to claim 8, wherein said silencing element is conical.

11. A muffler for a marine engine exhaust system according to claim 8, wherein said silencing element includes a portion thereof generally parallel to the flow path of exhaust gas.

12. A muffler for a marine engine exhaust system according to claim 8, further including a second silencing element disposed in downstream relation relative to said first silencing element, said second silencing element including a plurality of apertures offset in a downstream direction relative to said first silencing element apertures.

13. A muffler for a marine engine exhaust system, said exhaust system having an substantially cylindrical exhaust duct formed about a longitudinal axis for conducting the flow of exhaust gases and entrained water from an engine downstream to the atmosphere, said muffler adapted for installation in the exhaust duct, said muffler comprising:

a generally conical silencing element defining first and second arrays of elongate apertures, said first array of elongate apertures disposed toward a base portion of said conical silencing element and said second array of elongate apertures disposed on the remaining body portion of said conical silencing element;

said first array of elongate apertures disposed angularly relative to the duct axis;

said second array of elongate apertures disposed perpendicular relative to the duct axis.

14. A muffler for a marine engine exhaust system according to claim 13, further including a third array of elongate apertures disposed generally perpendicular to said first array of apertures.

* * * * *